United States Patent [19]

Whyte

[11] Patent Number: 4,627,578

[45] Date of Patent: Dec. 9, 1986

[54] METHODS OF AND/OR APPARATUS FOR DETECTING AND CONTROLLING REFINER PLATE CLASHING

[75] Inventor: Donald M. Whyte, Kawerau, New Zealand

[73] Assignee: Tasman Pulp and Paper Company Limited, Kawerau, New Zealand

[21] Appl. No.: 217,805

[22] Filed: Dec. 18, 1980

[30] Foreign Application Priority Data

Dec. 19, 1979 [NZ] New Zealand ..... 192459

[51] Int. Cl.[4] ..... G08B 21/00; B02C 7/14

[52] U.S. Cl. ..... 241/30; 241/34; 241/37; 241/259.1

[58] Field of Search ..... 241/30, 34, 35, 37, 241/259.1, 259.2, 259.3

[56] References Cited

U.S. PATENT DOCUMENTS 3,847,359 11/1974 Holmes et al. ..... 241/37 X 4,233,600 11/1980 Rogers ..... 241/37 X

*Primary Examiner*—Howard N. Goldberg

*Assistant Examiner*—Timothy V. Eley

*Attorney, Agent, or Firm*—Holman & Stern

[57] ABSTRACT

A method and apparatus for predicting and/or preventing the clashing of refiner plates which comprises sensing decreases in vibrations of the refiner plates due to a reduction in the quantity of material flowing between the refiner plates and includes controlling the distance between the refiner plates.

14 Claims, 8 Drawing Figures

= 3 MICRON FILTER IN PUMP LINE TO SOLENOID VALVE TO PROTECT VALVE AGAINST FINE SOLIDS TO PREVENT VALVE MALOPERATION

METHODS OF AND/OR APPARATUS FOR DETECTING AND CONTROLLING REFINER PLATE CLASHING

FIELD OF THE INVENTION

This invention relates to methods of and/or apparatus for predicting and/or controlling the clashing of refiner plates.

DESCRIPTION OF THE PRIOR ART

Refiners shred wood chips into wood pulp by passing the chips between closely spaced refiner plates in relative motion. The plates are urged together for example by hydraulic piston and cylinder assemblies. The plates are held apart only by the wood chips passing between the plates. If the supply of wood chips reduces or ceases the plates move into contact and in this condition, known as clashing, increased wearing of the plates occurs. If the clashing is prolonged the plates can be destroyed and even short term clashing if repeated frequently can cause great shortening of plate life. Plate life can be reduced to an average of as little as 400 hours.

Attempts to detect plate clashing have used techniques of measuring increased work, increased energy requirements, or bearing vibration resonances during clashing and then backing off the plates but these techniques have been disadvantageous as in order to function actual clashing must occur which of course means that increased refiner plate wear will still occur.

BRIEF SUMMARY OF THE INVENTION

It is an object of the present invention to provide a method of and/or apparatus for predicting and/or controlling the clashing of refiner plates which will obviate or minimize the foregoing disadvantages in a simple yet effective manner.

Accordingly in one aspect the invention consists in a method of predicting the clashing of refiner plates comprising the step of sensing decreases in vibrations of said refiner plates due to a reduction in the quantity of material flowing between said refiner plates.

In a further aspect the invention consists in a method of controlling the relative position of refiner plates comprising the steps of sensing decreases in vibrations of said refiner plates due to a reduction in the quantity of material flowing between said refiner plates and causing the distance between said refiner plates to be increased before engagement of said refiner plates occurs.

In still a further aspect the invention consists in apparatus for predicting the clashing of refiner plates comprising vibration sensing means to detect vibrations caused by passage of material between said refiner plates, and detection means to detect any decrease in vibrations due to a reduced quantity of material passing between said refiner plates.

In a still further aspect the invention consists in apparatus for controlling the relative position of refiner plates comprising vibration sensing means to detect vibrations caused by passage of material between said refiner plates, detection means to detect any decrease in vibrations from normal or safe operating conditions due to a reduced quantity of material passing between said refiner plates and control means to increase the distance between said refiner plates when said detection means detects said decreased vibrations to substantially prevent clashing of said refiner plates.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DETAILED DESCRIPTION

In the preferred form of the invention, a refiner is provided which is substantially standard as follows:

A pair of static members 1 and 2 are provided which may be moved in the direction of arrows 3 and 4 respectively by a suitable means such as piston and cylinder assemblies indicated schematically at 5 and 6.

Figure 2:
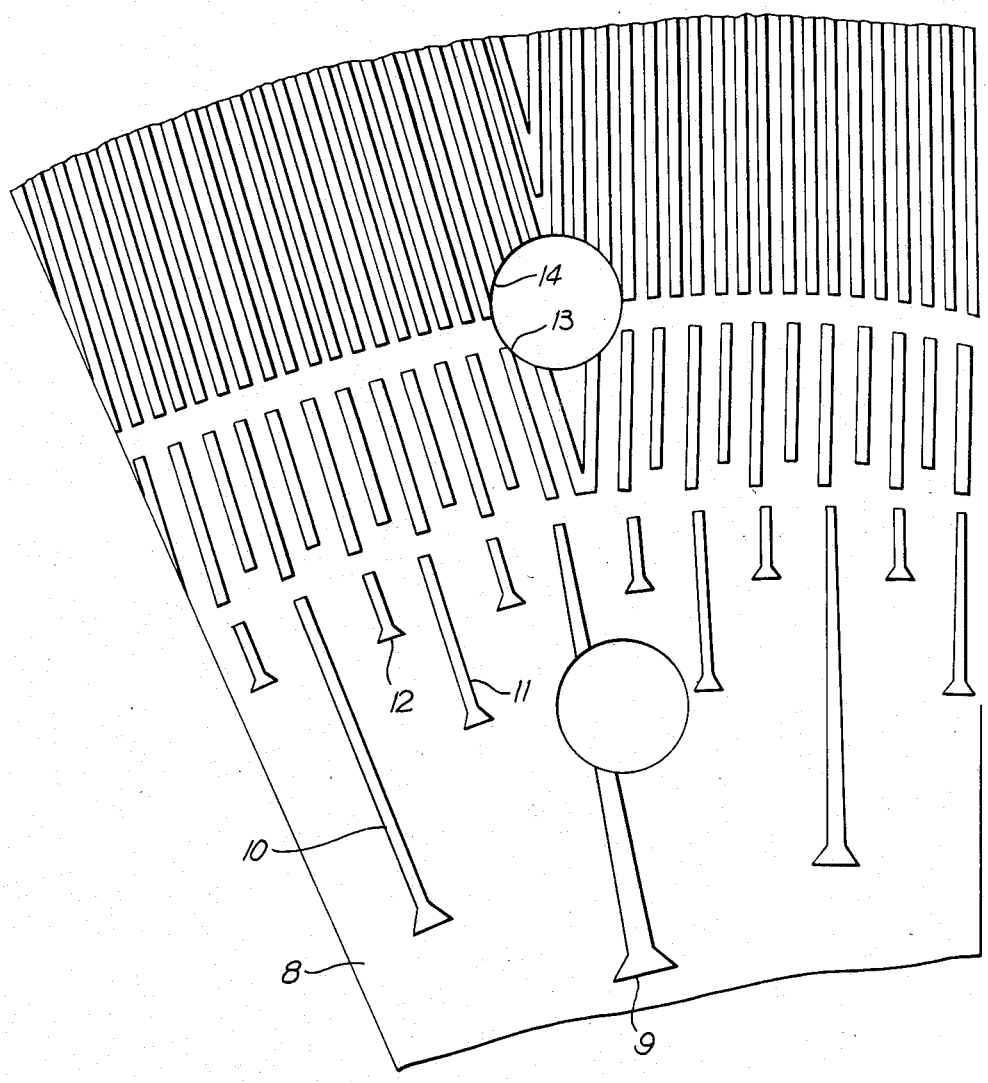
FIG. 2 is an elevational view of part of a refiner plate of the type used in apparatus according to the invention, FIGS. 3 and 5 comprise simplified graphs of variation levels against time for two different vibration frequencies of the refiner plates.

The static members 1 and 2 carry refiner plates a part or segment of which is shown in FIG. 2 at 8. A refiner plate is bolted onto a suitable receiving element on each of the members 1 and 2.

The plates 8 include sequences of ribs such as rib 9, ribs 10, ribs 11, ribs 12, ribs 13 and ribs 14.

A rotatable refiner member 15 driven through shaft 16 is disposed between static members 1 and 2 and bears similar plates to the plates 8 for cooperation therewith in refining material between the opposed plates.

Thus material to be refined such as wood chips are inserted for example in the direction of arrows 17 and pass between the plates where they are refined by a shearing action between the ribs to emerge, for example, as wood pulp, in the direction shown by arrows 18 for example.

The distance between the stationary members 1 and 2 and the rotational member 15 is maintained by the physical bulk of chips or pulp between the refiner plates acting against the pressure of piston and cylinder assemblies 5 and 6.

Should the quantity of material such as wood chips passing to the refiner cease the refiner plates would therefore engage one with the other or "clash" and cause damage.

Figures 3, 4, 5, 6:
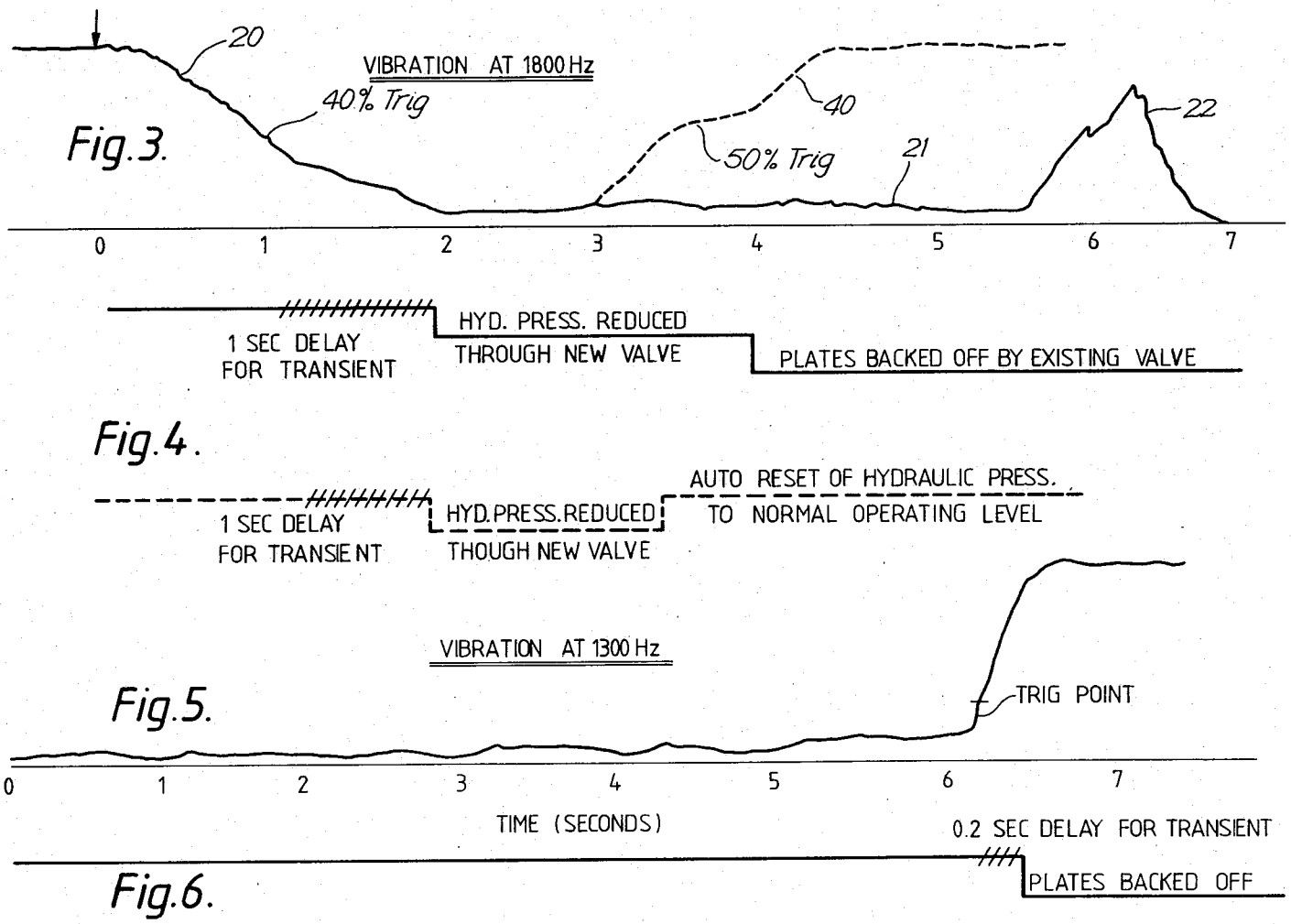
FIGS. 4 and 6 show time sequences for controlling apparatus causing pressure between said refiner plates for the vibration frequencies of FIGS. 3 and 5, respectively and, FIG. 7 is a block diagram of a suitable control circuit for use in the invention.

However, referring to FIG. 3 for example, if a plot of vibration intensity against time from a time zero when chip feed is stopped to a time seven seconds after engagement of the plate has occurred it is found that during the first approximately two seconds a decrease in vibration occurs in the region 20 of the graph. During the next period of approximately 3½ seconds in the area 21 a lower plateau of vibration is recorded before the vibration peak at 22 occurs during clashing. This provides a basis on which pressure from the piston and cylinder assembly such as 5 and 6 can be reversed to prevent the engagement or clashing of the plates taking place.

Figure 1:
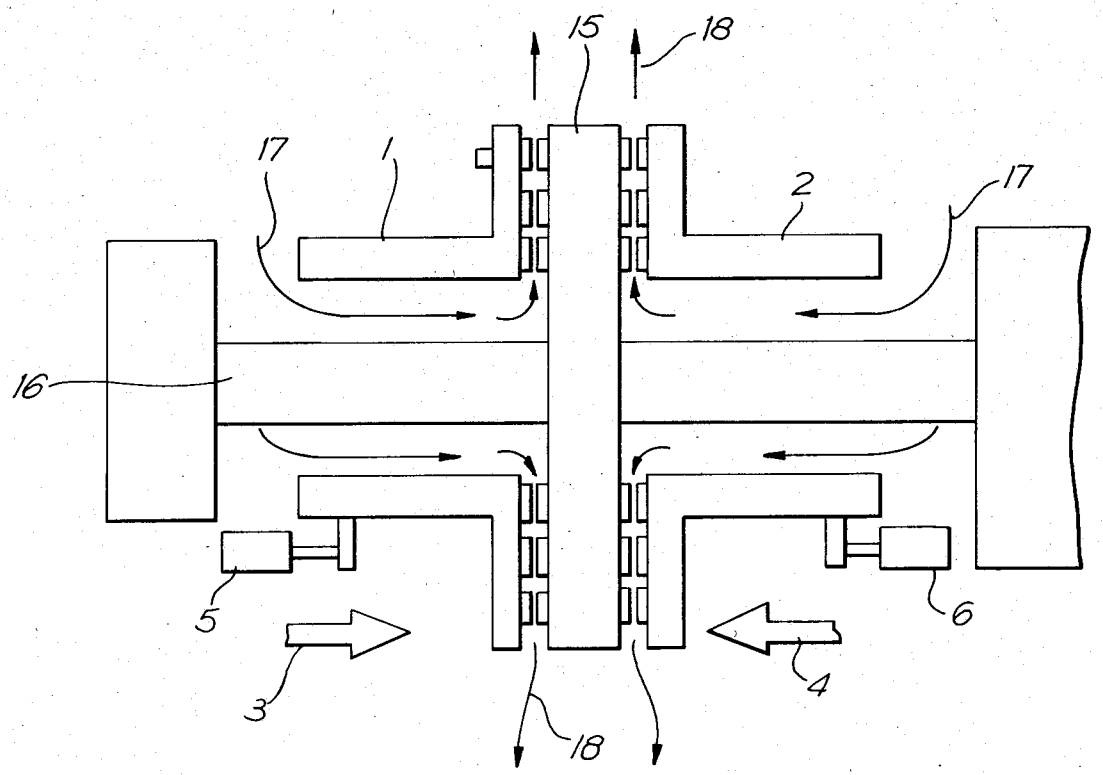
FIG. 1 is a basic schematic representation of a refiner for use with the invention.
Figure 7:
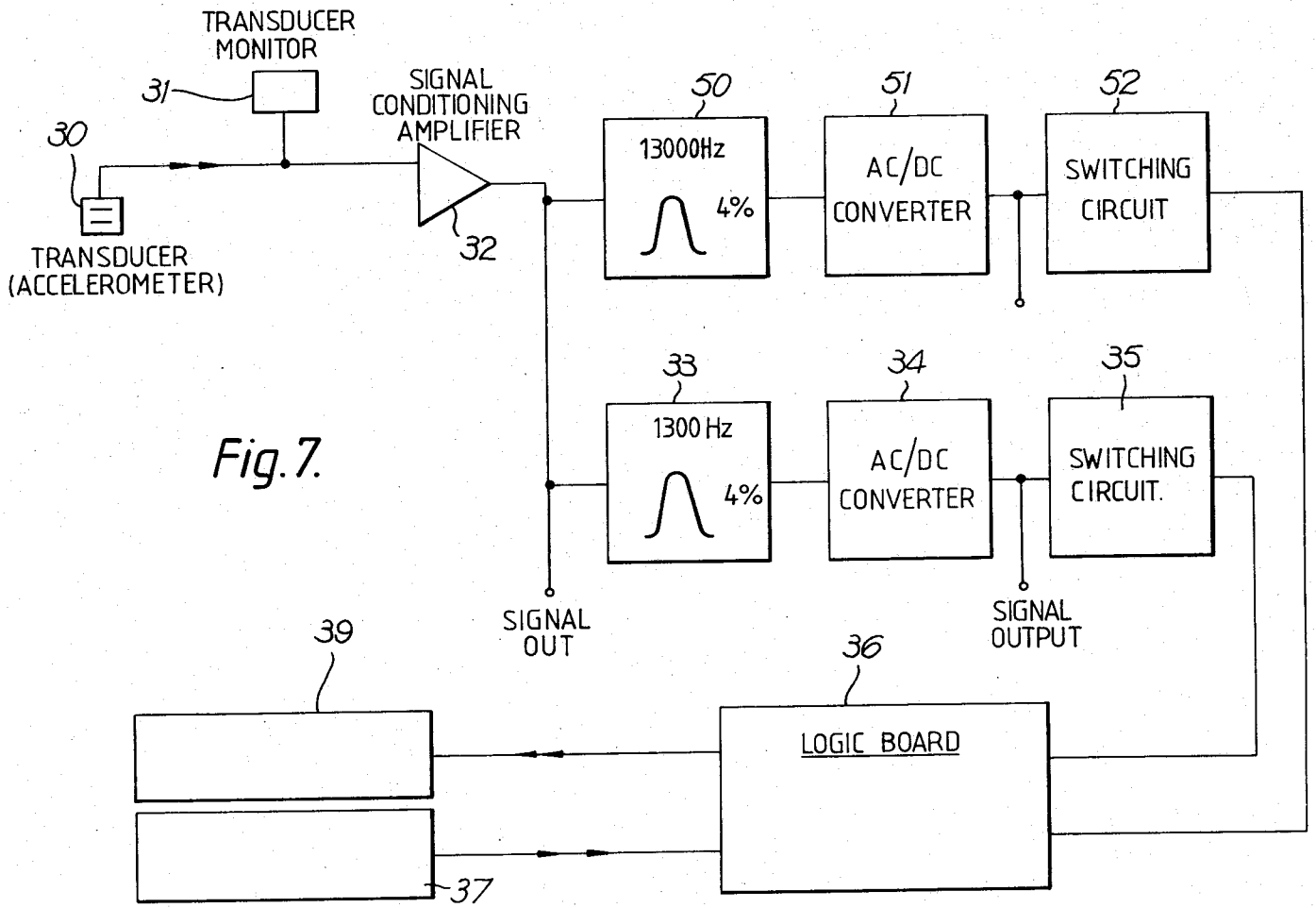
Figure 8:
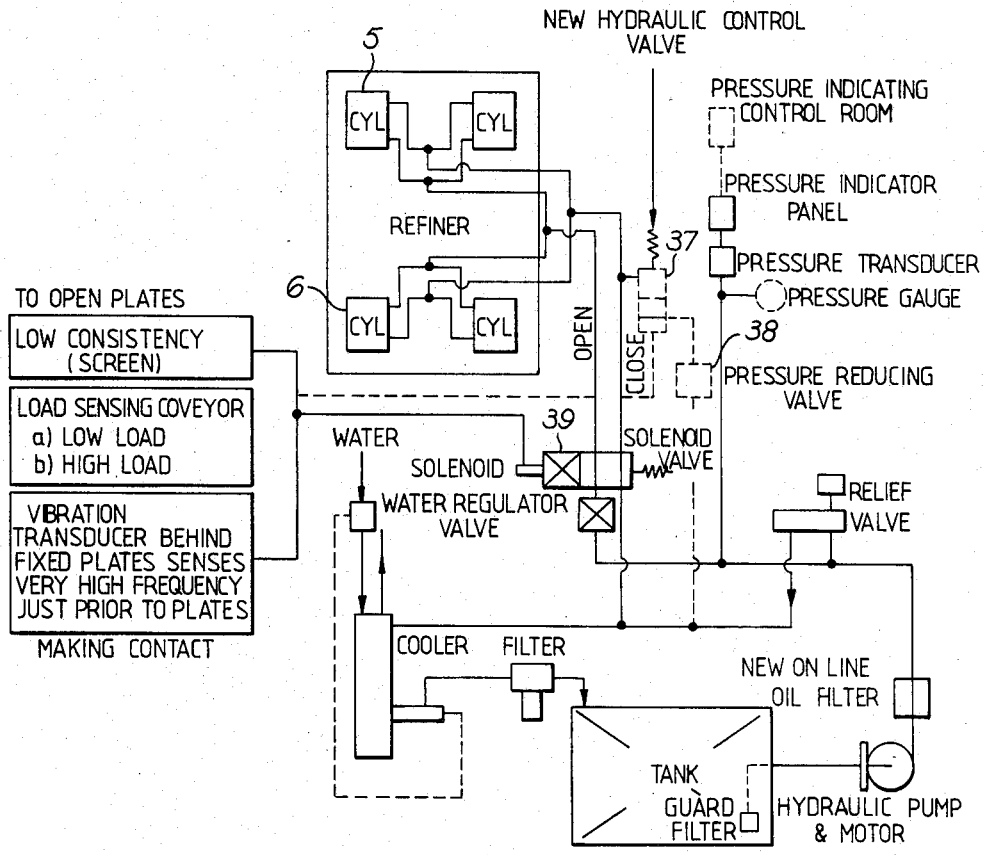
FIG. 8 shows one form of hydraulic control for a piston and cylinder assembly causing pressure between refiner plates according to the invention.

Referring to FIG. 7, vibration sensing means such as a transducer 30 is provided which can be fixed for example to one of the stationary plates as shown in FIG. 1.

This tranducer is preferably an accelerometer arranged in such a manner that a voltage increase occurs when a vibration increase occurs. A decreased vibration is arranged to cause a voltage decrease through transducer 30.

Transducer monitor 31 indicates that the transducer is working correctly.

The voltage output from transducer 30 is preferably amplified in a signal conditioning amplifier 32.

Detection means are provided to detect that a vibration decrease has occurred and to this end a filter is provided at 33 to pass a desired frequency.

Thus for example and referring to FIG. 2 alternate ribs 10 and 11 in the construction shown will provide a vibration frequency of substantially 1800 Hz there being 12 plates in a disc, 6 bars per plate, and a frequency of rotation of about 1,500 rpm.

The selected varying voltage is then converted in an AC/DC converter to a DC voltage which is substantially proportional to the amplitude of the vibrations at substantially that frequency. A switching circuit 35 is arranged to cause switching when the voltage from the AC/DC convertor falls below a substantially predetermined level, for example 40% of the average working vibration level.

A logic board 36 is provided so that the switching can be caused to control the piston and cylinder assemblies 5 and 6.

Thus by way of example if the output from the AC/DC convertor 34 falls to for example 40% of the operating level for a period of say one second (see FIGS. 4 and 5), a control valve 37 is operated which operates a pressure reducing valve now shown to cause the pressure in piston and cylinder assemblies 5 and 6 to be reduced.

If the signal returns to 60% of the operating level for example shown by dotted line 40 in FIG. 3, after say 2 seconds, the system resets through valve 37.

If the operating level has not returned after a two second period, solenoid valve 39 is reversed causing the piston and cylinder assembles 5 and 6 to withdraw so that the plates are withdrawn one from the other.

As a back up system a further frequency for example a frequency caused by ribs 14 which in the example given would be at about 13,000 Hz, can be sensed through filter 50, and AC/DC convertor 51 and a switching circuit 52 are provided.

The vibrator curve for this type of arrangement is shown in FIG. 5 and it can be seen that the vibrations remain at a low level during the "chip run-out" period and then increase quickly when clashing of the plates is imminent. The piston and cylinder assemblies 5 and 6 can be caused to back off when vibration has reached a predetermined level for example about 200% of the base level.

The use of the invention is as follows:

In use, the transducer is mounted on the refiner for example, adjacent one of the stationary refiner plates.

Should the input feed for example of pulp stop during the period in which the pulp within the refiner passes through the device, pulp induced vibrations will decrease because of the decrease in work done on the pulp by the refiner plates. The transducer senses the decreased vibrations and after a delay, if desired to allow transient decreases in pulp flow to be ignored, the means such as the piston and cylinder assemblies which cause the plates to be forced together can be reversed to cause the plates to be withdrawn.

Thus it can be seen that at least in the preferred form of the invention a method and/or apparatus of predicting and/or controlling clashing of refiner plates are provided which allows the refiner plates to be moved to increase the distance between the refiner plates prior to clashing or engagement of the plates is substantially prevented.

It is believed that with the present invention plate life can be substantially doubled for example from a present expected life of 400–600 hours on average to an expected life of close to 1,000 hours on average. Also the apparatus is simple to produce and can be introduced into existing refiners in a simple manner making substantial use of the existing, in particular, hydraulic circuits of the refiner.

What is claimed is:

1. A method of predicting the clashing of refiner plates comprising the steps of sensing the vibration of at least one refiner plate during normal safe operation, sensing decreases in vibration of said at least one refiner plate due to a reduction in the quantity of material flowing between said refiner plates, and producing a signal in response to said decrease in vibration.

2. A method of predicting the clashing of refiner plates as claimed in claim 1 and further comprising the step of producing a signal indicating the lowest desired frequency of vibration of said at least one refiner plate.

3. A method for preventing the clashing of refiner plates comprising the steps of sensing the vibration of at least one refiner plate during normal safe operation, sensing decreases in vibration of said at least one refiner plate due to a reduction in the quantity of material flowing between said refiner plates, producing a signal in response to said decrease in vibration, and causing the distance between said refiner plates to be increased before clashing of said refiner plates in response to said signal.

4. A method of preventing the clashing of refiner plates as claimed in claim 3 and further comprising selecting the lowest desired frequency of vibration of said refiner plates and producing a signal at said lowest vibration in response to which said distance between the refiner plates is increased.

5. A method of preventing the clashing of refiner plates as claimed in claim 4 wherein said step of causing the distance between said refiner plates to be increased comprises operating a piston and cylinder assembly to move said refiner plates apart.

6. A method of preventing the clashing of refiner plates as claimed in any one of claims 3 to 5 and further comprising producing a pressure to operate a piston and cylinder assembly to force said plates together, and reducing said pressure for a predetermined period of time before the distance between said plates is substantially increased.

7. Apparatus for predicting the clashing of refiner plates comprising vibration sensing means mounted on said apparatus to detect vibrations caused by passage of material between said refiner plates, and detection means to detect any decrease in vibrations from normal operating conditions due to a reduced quantity of material passing between said refiner plates.

8. Apparatus for predicting the clashing of refiner plates as claimed in claim 7 wherein said vibration sensing means comprises at least one transducer producing a voltage output signal substantially proportional to the vibration generated by said refiner plates.

9. Apparatus for predicting the clashing of refiner plates as claimed in claim 8 and further comprising a filter adapted to receive said signal and pass a substantially predetermined output frequency from said transducer.

10. Apparatus for preventing the clashing of refiner plates comprising vibration sensing means mounted on the apparatus to detect vibrations caused by passage of material between said refiner plates, detection means to detect any decrease in vibrations from normal safe operating conditions due to a reduced quantity of material passing between said refiner plates and control means operably connected to said refiner plates to increase the distance between said refiner plates when said detection means detects said decreased vibrations to prevent clashing of said refiner plates.

11. Apparatus for preventing the clashing of refiner plates as claimed in claim 10 wherein said vibration sensing means comprises at least one transducer producing a voltage output signal substantially proportional to the vibration generated by said refiner plates.

12. Apparatus for preventing the clashing of refiner plates as claimed in claim 11 and further comprising a filter adapted to receive said signal and pass a substantially predetermined output frequency from said transducer.

13. Apparatus for preventing the clashing of refiner plates as claimed in claim 12 wherein said control means comprises at least one reversable piston and cylinder assembly operably connected with said refiner plates to move said plates toward each other to produce a pressure between said plates and withdraw said plates from each other and valve means operated by the output signal from said filter to control said piston and cylinder assembly.

14. Apparatus for preventing the clashing of refiner plates as claimed in claim 13 wherein at least one transducer is mounted on at least one refiner plate, and said control means further comprises a first valve to reduce said pressure for a predetermined period and a second valve to reverse said piston and cylinder assembly to withdraw said plates if said vibration level does not return to a further substantially predetermined level within a predetermined time.

* * * * *